US005941182A

United States Patent [19]

Greene

[11] Patent Number: 5,941,182

[45] Date of Patent: Aug. 24, 1999

[54] SELF-BRAKING HEIGHT ADJUSTMENT MECHANISM

[75] Inventor: H. Peter Greene, Montgomery County, Pa.

[73] Assignee: Knoll, Inc., East Greenville, Pa.

[21] Appl. No.: 08/865,360

[22] Filed: May 29, 1997

[51] Int. Cl.[6] ..... A47B 9/00

[52] U.S. Cl. ..... 108/147; 108/147.19

[58] Field of Search ..... 108/144.11, 147, 108/147.19; 248/125.2, 404, 188.5

[56] References Cited

U.S. PATENT DOCUMENTS

| | | | |
|---|---|---|---|
| 3,385,238 | 5/1968 | Jay . | |
| 3,568,804 | 3/1971 | Olsen . | |
| 3,727,871 | 4/1973 | Harper | 248/406.1 |
| 3,737,136 | 6/1973 | Snurr | 108/147.19 X |
| 4,604,955 | 8/1986 | Fleischer et al. . | |
| 4,619,208 | 10/1986 | Kurrasch . | |
| 4,627,364 | 12/1986 | Klein et al. . | |
| 4,627,591 | 12/1986 | Heckmann | 108/148 X |
| 4,635,565 | 1/1987 | Novak . | |
| 4,747,320 | 5/1988 | Nilsson . | |
| 4,747,353 | 5/1988 | Watt . | |
| 4,757,887 | 7/1988 | Ostrander et al. | 192/41 A |
| 4,922,836 | 5/1990 | Damico . | |
| 5,022,327 | 6/1991 | Solomon . | |
| 5,259,326 | 11/1993 | Borgman et al. . | |
| 5,289,782 | 3/1994 | Rizzi et al. . | |
| 5,311,827 | 5/1994 | Greene . | |
| 5,322,025 | 6/1994 | Sherman et al. . | |
| 5,365,862 | 11/1994 | Peterson . | |
| 5,373,793 | 12/1994 | Crossman . | |
| 5,400,721 | 3/1995 | Greene . | |
| 5,447,099 | 9/1995 | Adams et al. . | |
| 5,598,788 | 2/1997 | Jonker . | |
| 5,598,789 | 2/1997 | Jonker . | |
| 5,601,037 | 2/1997 | Meyer et al. . | |
| 5,685,510 | 11/1997 | Frankish | 108/147 |

OTHER PUBLICATIONS

The Torrington Company, 1988. "Drawn Cup Roller Clutches" section of catalog.

*Primary Examiner*—Peter M. Cuomo
*Assistant Examiner*—Janet M. Wilkens
*Attorney, Agent, or Firm*—Buchanan Ingersoll, P.C.

[57] ABSTRACT

A vertically adjustable workstation comprises one or more legs having a vertical adjustment mechanism which provides an automatic self-braking function. The vertical adjustment mechanism comprises a highly efficient rotating member, such as a ball screw and ball nut assembly. Securely attached to the ball screw and the work surface is a clutch mechanism. The clutch mechanism has on one end a friction cap which is frictionally engaged with the work surface, and a thrust bearing which provides a first rotational interface between the ball screw and the clutch mechanism. The clutch mechanism comprises a roller clutch which allows for free rotation of the ball screw in the upward direction and is engaged with the ball screw when rotated in a downward direction. This arrangement comprises a load path which is directed from the work surface through the mating friction surfaces, the clutch mechanism and thrust bearing into the ball screw. The frictional rotational interface between the table and the friction cap of the clutch mechanism provides the self-braking feature such that backwinding of the table is prevented. A collapsible handle is operatively connected to the ball screw.

28 Claims, 9 Drawing Sheets

SELF-BRAKING HEIGHT ADJUSTMENT MECHANISM

BACKGROUND OF THE INVENTION

1. Field of the Invention

This invention relates to a self-braking height adjustment mechanism, and more particularly to a self-braking vertical adjustment mechanism for a table or workstation that can be easily adjusted relative to the weight being supported by the table or workstation.

2. Description of the Prior Art

Furniture components, such as computer workstations or the like, have various types of height adjustment mechanisms. These surfaces, while supporting heavy equipment such as computer monitors, terminals and various other desk accessories, are desired to be vertically adjustable so as to accommodate a variety of tasks or a variety of users easily and comfortably. Examples of such adjustable workstations are U.S. Pat. Nos. 5,598,788 and 5,598,789, both assigned to the present assignee and incorporated herein by reference.

By way of illustration, these adjustable mechanisms allow the tabletop to be adjusted upwardly or downwardly to accommodate the different user or task. Various means such as springs, pulley arrangements, worm-gear, screw arrangements or counterbalancing weights are used to provide relatively effortless raising and lowering of the table surface.

One common type of height adjustment mechanism is a screw arrangement wherein a hand crank is used to rotate a screw mechanism which causes the table surface to either rise or lower according to the wishes of the user. One problem associated with these types of hand crank mechanisms is that excessive torque may be required on the crank to lift heavier loads, such as on the order of 250 to 300 pounds, particularly when a desirable lift rate is one inch of lift for every four or five turns of the crank handle. This is commonly accomplished by the use of an Acme thread screw in either one or both sides of the table base and to synchronize the left and right sides with a sprocket and chain assembly or other means.

What is needed then is a more efficient torque to force conversion mechanism whereby the table can be easily raised or lowered by an operator using a simple hand crank mechanism. Moreover, it would be desirable if the operator could use the same amount of cranking force to both raise and lower the table relative to the amount of weight on the table. Another important consideration is to prevent backwinding of the table once it reaches the desired height regardless of the amount of weight placed on the table.

A more efficient way to convert a cranking torque to a lifting force is to use an efficient rotational interface such as a ball thread assembly consisting of a ball screw and a ball nut. A ball thread assembly represents an efficient rotational interface since rolling and not sliding is the torque to force conversion mechanism. With this type of an arrangement 95% or more of the cranking torque is converted to lifting force, thus cranking torque is kept to a minimum. However, because it is such a highly efficient conversion mechanism, this mechanism may not adequately maintain the lifted load in a desired position; that is, backwinding of the ball screw and lowering of the work table may occur. The use of a brake or lock to prevent backwinding thus becomes necessary. U.S. Pat. No. 3,385,238 issued to Jay is an example of such an arrangement. However, it is desirable to do so without the input or awareness of the user. In addition, the braking mechanism must not lessen the efficiency of the ball screw assembly in the lifting direction, which would require greater cranking force for a given load. It must not inadvertently disengage at any time since that may present the user with a sudden, uncontrollable burst of torque in either the lifting or lowering directions. In addition, it is most desirable that the magnitude of the lowering torque be similar to that required for the raising torque; and as the cranking torque in the lift direction will increase with additional loading, so should the lowering torque so that the operator is unaware of the automatic braking provided by the lift mechanism.

The use of a hand crank mechanism is a simple and effective means of applying the cranking torque to the ball thread assembly. A handle which is gripped and rotated by the user is connected through a suitable linkage mechanism to the ball screw. While it is desirable that the handle be easily accessible by the operator, it is also advantageous that the handle not obstruct either the work surface, or the area under the desk in which orientation of the handle may be inadvertently bumped by the user, causing both discomfort to the user as well as unintended operation of the height adjustment mechanism. Although the use of a removable handle would solve this problem, it has the potential to result in loss or misplacement which prevents adjustment of the work surface.

SUMMARY OF THE INVENTION

It is therefore an object of the present invention to provide an efficient height adjustment mechanism for a work surface which can be raised or lowered by the operator with relative ease.

It is another object of the present invention to provide an adjustable work table which prevents backwinding, a typical result of an efficient lift mechanism such as a ball screw and ball nut.

It is a further object of this invention to provide a lift mechanism wherein the torque required to lower the table is substantially similar to the torque required to raise the table for any given load.

It is a still further object of the present invention to provide a handle assembly which is readily accessible by a user, but one which can be conveniently stored in an unobstructive manner.

These and other objects of the invention are provided by the vertically adjustable workstation of the present invention which comprises a work surface connected to a base. The base includes a movable portion and a stationary portion, the work surface being connected to the movable portion. The movable portion includes a vertical adjustment mechanism having an automatic braking mechanism for locking the work surface in a vertical position.

In a preferred embodiment, the vertical adjustment mechanism comprises a rotational member. This rotational member most preferably comprises a vertically movable ball screw which threadingly engages a ball nut which is rigidly secured to the leg portion. The ball screw is rotated by a handle crank so as to move the ball screw up and down with respect to the leg.

The automatic brake assembly preferably comprises a clutch mechanism which is secured to the ball screw. The clutch mechanism is comprised of a roller clutch, pressed into an outer sleeve, which is fixed to a friction cap. A thrust needle bearing is disposed between the roller clutch and the ball screw. The work surface provides a non-rotation friction surface. The clutch mechanism allows for free rotation of the ball screw within the clutch during upward translation of the work surface, while the clutch mechanism engages the ball screw and rotates therewith when the ball screw is rotated in a downward direction. This feature, along with the disposition of the elements allows the rotation-thrust interface to occur within the thrust needle bearing while lifting, but forces this interface to occur between the non-rotating friction surface and friction cap while at rest or lowering; thus preventing backwinding. Since the load on the work surface is being carried by the screw, and through the friction surfaces, any change in load results in a relative change in the friction force, thus the (automatic) self-adjustment feature is provided.

In another embodiment of the present invention, a collapsible handle assembly is provided. The handle remains attached to the table and is pivotally connected to the shaft. The handle can be locked in either an operating position or a collapsed position.

BRIEF DESCRIPTION OF THE DRAWINGS

These and other objects, features and advantages of the invention will become more apparent by reading the following detailed description in conjunction with the drawings, which are shown by way of example only, wherein:

FIG. 2, consisting of FIGS. 2A and 2B, shows a side elevational view of the adjustable height table leg with the cover removed, FIG. 2A showing the leg in its lowermost position while

DETAILED DESCRIPTION OF THE PREFERRED EMBODIMENTS

Figure 1:
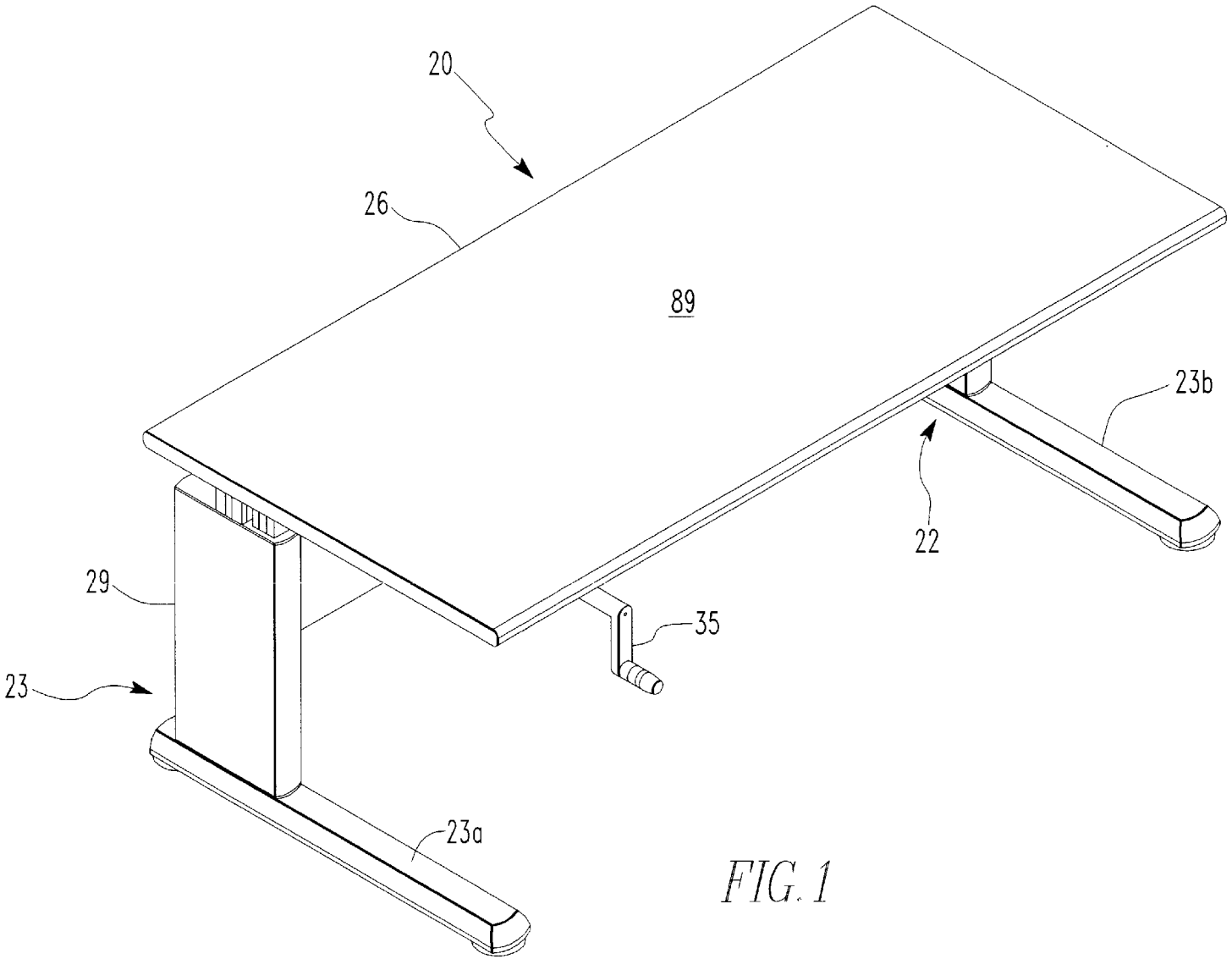
FIG. 1 is a perspective view of a height adjustable table in accordance with the present invention.
Figure 2A:
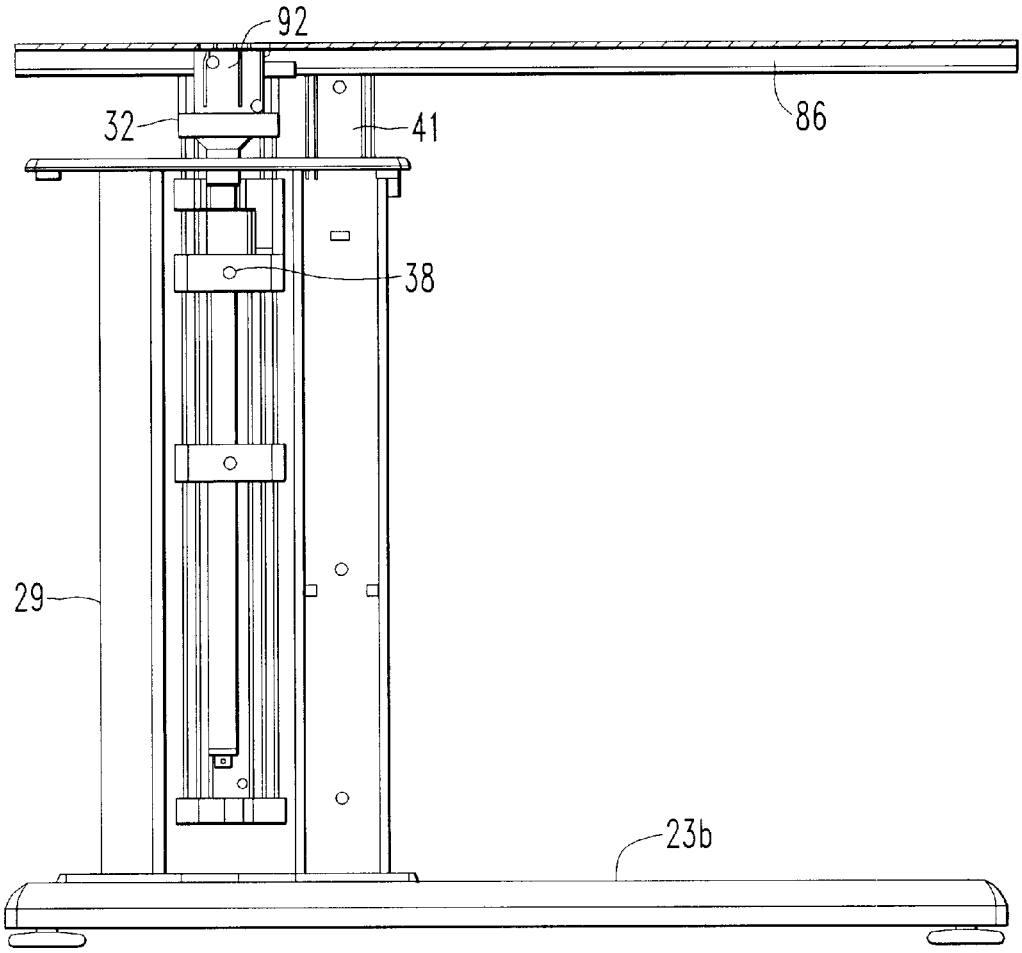
Figure 2B:
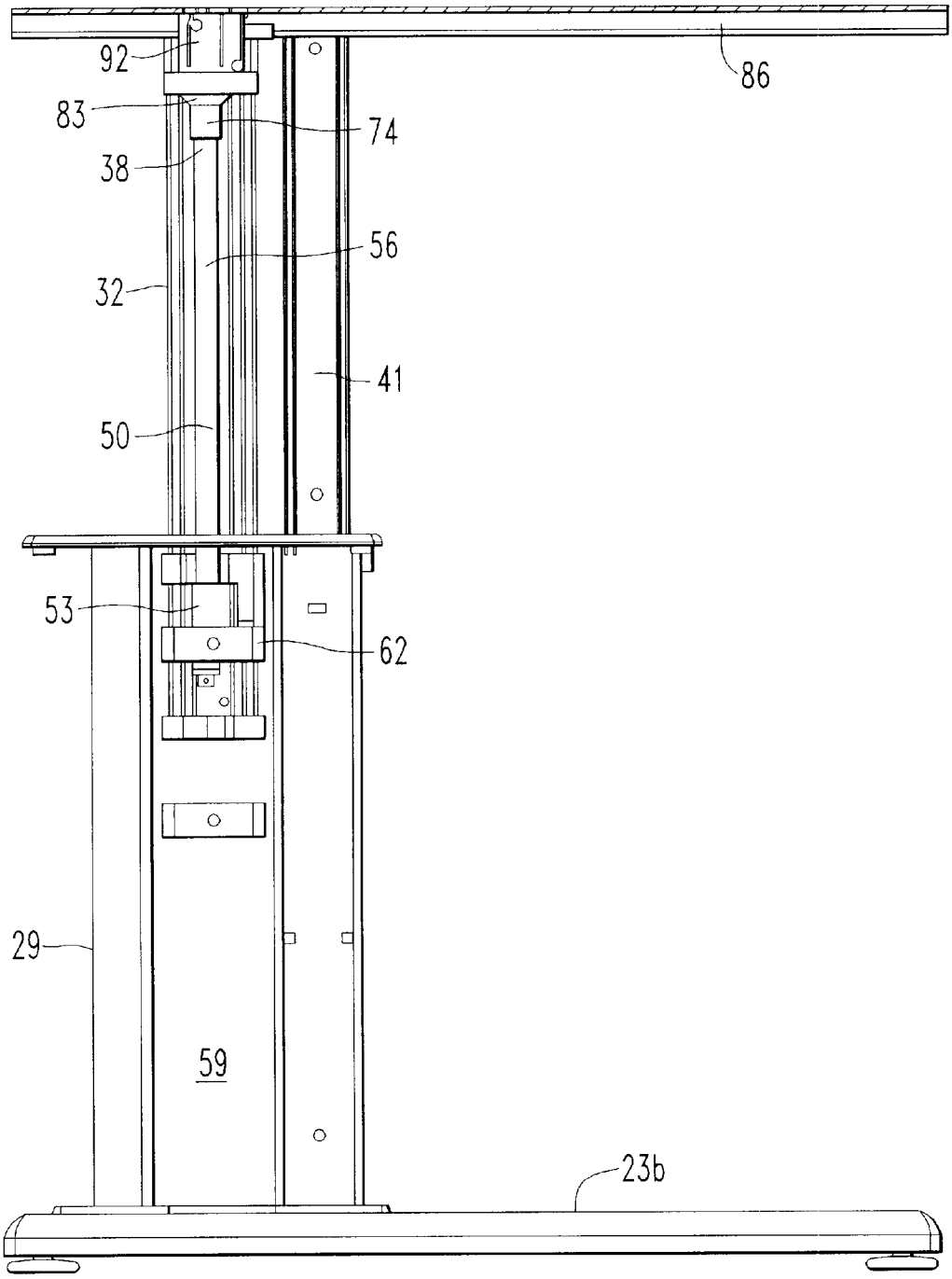
FIG. 2B shows it in its uppermost position.

Referring now to the drawings in detail, FIG. 1 shows a vertically adjustable table or workstation 20 in accordance with the present invention, which includes a base 22 comprising a pair of leg assemblies 23 supporting a work surface 26 in various positions relative to the floor or the user. Each leg assembly 23 comprises a stationary portion 29 and a movable portion 32. The work surface is easily adjustable by the means of a crank handle 35. Although the crank handle is shown positioned on the left side of the table 20 in association with the left leg 23*a*, it is to be readily understood that the crank handle and the lift mechanism of the present invention could be incorporated in the right leg 23*b*. Also, instead of a pair of legs, the work surface can be supported by a base assembly which comprises a pedestal or single leg. FIG. 2 shows the work surface 26 in its lowermost (FIG. 2A) and its uppermost (FIG. 2B) positions. FIG. 2 also shows an exposed view of the self-braking height adjustment mechanism 38 of the present invention shown in the right leg assembly 23*b*.

Figure 3:
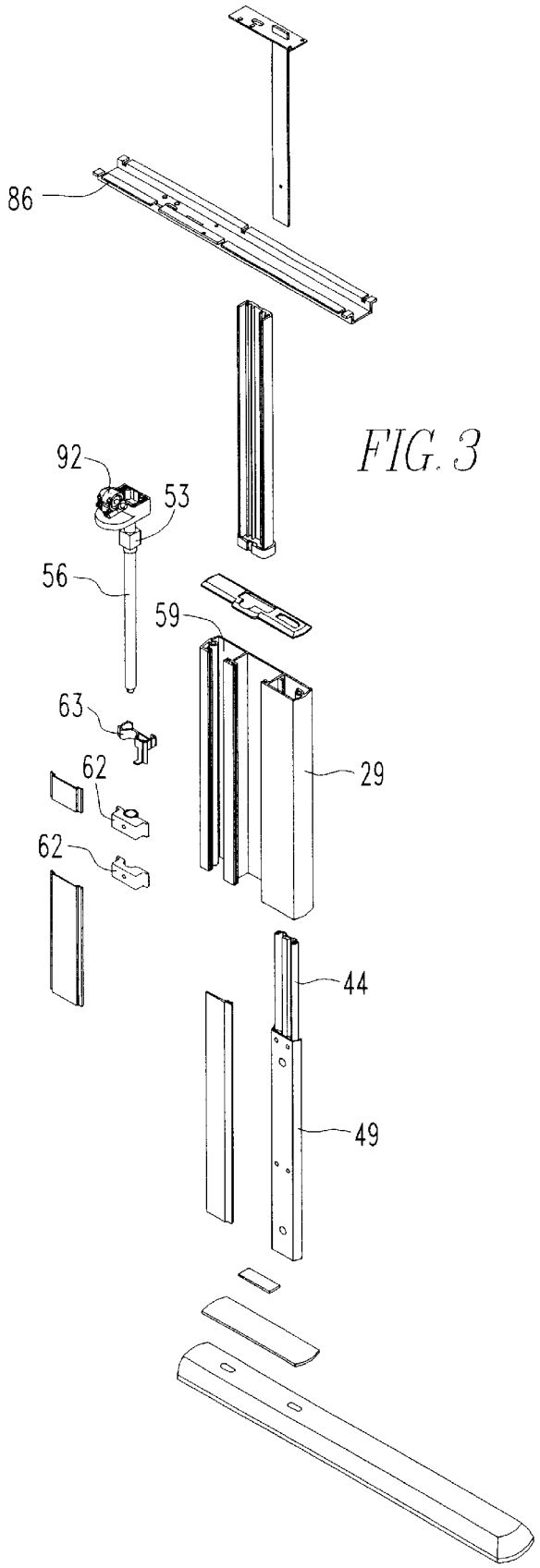
FIG. 3 is an exploded view of one leg of the adjustable table showing the self-braking height adjustment mechanism of the present invention shown therein.
Figure 4:
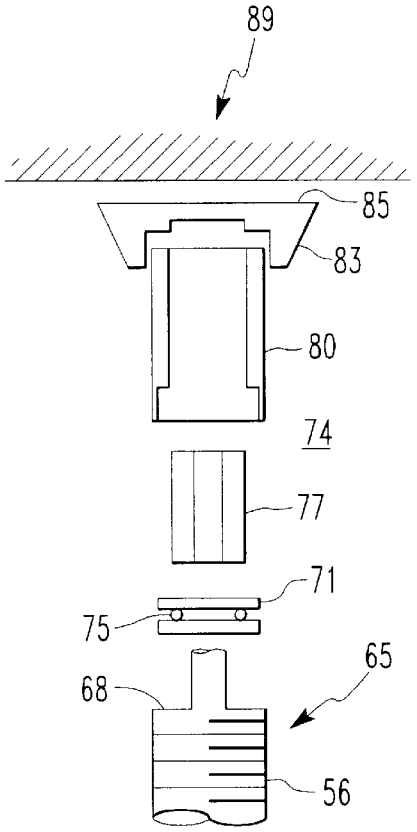
FIG. 4 is a schematic representation of the brake assembly of the self-braking height adjustment mechanism of the present invention.

Referring specifically now to FIGS. 2–4, the principles of the self-braking height adjustment mechanism 38 of the present invention will be described in detail. The movable portion 32 disposed within at least one of the legs comprises the self-braking height adjustment mechanism assembly and a slide assembly 41 which assists in the raising and lowering of the table surface 26. The slide assembly is preferably a conventional drawer slide mechanism mounted vertically wherein a first member 44 is slidably engaged in a second member 49 in a telescoping fashion for the ease of raising and lowering of the work surface 26 with respect to the leg assemblies 23. The movable portion 32 in the other leg preferably comprises a slide assembly, but does not include a self-braking height adjustment mechanism assembly. In the preferred embodiment this slide assembly is Model ULFHD 584/381 drawer slide assembly manufactured by Thomas Regout U.S.A.

The lift mechanism comprises a rotating member 50, which in the preferred embodiment comprises a ball screw. In the preferred embodiment the lift mechanism also comprises a ball nut 53 rigidly affixed to the stationary portion 29 of the table, preferably within the leg assembly. In operation, as the ball screw is rotated within the ball nut, the ball screw is raised or lowered depending on the direction of rotation, either clockwise or counterclockwise, of the ball screw within the ball nut. As will be described more fully hereinafter, the ball screw 56 is fixedly attached to the adjustable work surface 26 such that as the ball screw translates up or down within the ball nut the work surface is correspondingly raised or lowered by the turning of the crank handle 35.

It is to be readily understood that the ball screw 56 may be the stationary member which, when rotated, causes the ball nut 53, which is rigidly secured to the adjustable work surface, to translate up or down.

In the preferred embodiment, the ball nut is fixedly secured within a channel 59 of the leg and may be supported against the leg within the channel by one or more attachment blocks 62 and bearing 63. The ball screw is threadingly engaged with the ball nut. The upper portion 65 of the ball screw (FIG. 4) has thereon a shoulder 68 which receives a thrust bearing 71. Attached to the thrust bearing opposite the shoulder is a clutch assembly 74. The clutch assembly comprises a roller clutch 77 which operates in one of two modes: a free rotational mode and a lock mode.

In the free rotational mode, the ball screw 56 is free to rotate without engaging the clutch 77 such that the shaft rotates within the clutch assembly 74, with the thrust bearing 71 providing a first rotational interface 75 between the ball screw and the clutch assembly. In the lock mode, the clutch rotates with the corresponding rotation of the ball screw. In the present invention, during the lifting operation (since lifting the load resists gravity which is down) the ball screw freely rotates within the clutch; and during the lowering operation the clutch rotates with the ball screw to provide the self-braking feature of the present invention, which will be described more fully hereinafter. In the most preferred embodiment, the roller clutch 77 comprises Model RCB-061014 provided by the Torington Company.

As shown in FIGS. 3 and 4, the self-braking height adjustment mechanism 38 of the present invention will be more fully described herein. The lifted surface 26 (which is the loaded computer workstation, for example) is operatively attached to the rotating lifting member, which is shown as comprising a ball screw 56. The ball screw is operatively connected to the work surface to lift the work surface by means of the clutch assembly 74, which further includes an outer sleeve 80 rigidly attached to the outer surface of the roller clutch along with a friction cap 83. The thrust bearing 71 rests on the shoulder 68 of the ball screw to provide a first or free rotational interface 75 for the lift mechanism during the lifting operation; whereas the friction cap comprises a second or frictional rotation interface 85 for the lift mechanism in the lowering operation since the ball screw is engaged with the roller clutch 77 causing the entire clutch mechanism 74 and the entire thrust bearing 71 to rotate. In this configuration, the load path from the work surface is directed through the mating friction surfaces and the clutch mechanism and thrust bearing into the ball screw.

In the raising operation, the ball screw 56 freely rotates within the clutch assembly 74, while the first rotational interface 75 provided by the thrust bearing allows for the ease of rotation of the ball screw via the hand crank 35. In this manner, the clutch 77 and friction cap 83 do not rotate. In the lowering operation, because the clutch is operatively associated with the ball screw such that the clutch operates in the lock mode; the entire clutch mechanism 74 rotates with the ball screw. Thus, the ball screw 56, thrust bearing 71, roller clutch 77, outer sleeve 80 and friction cap 83 rotate such that the second rotational interface 85 between the friction cap and the loaded surface allows for a controlled lowering with a similar force as that required to lift the same load. While FIG. 4 schematically shows the load 89 or friction surface resting directly on the friction cap 83, it will be readily understood that an intermediate member, such as a support bracket 86 between the lifting mechanism and the table may be provided. Moreover, the ball screw may be operatively connected to the crank handle by a shaft and gear box mechanism 92, or other mechanisms well known to those skilled in the art.

The clutch mechanism also provides the self-braking feature. Since the friction force between the friction cap and the lifted surface is proportional to the load 89 on the lifted surface, the braking mechanism self-adjusts to the amount of weight on the computer workstation, for example. Since the clutch engages the shaft during the lowering motion, the tendency of the ball screw to backwind when a heavy load is placed on the table is counteracted by the automatic operation of the braking mechanism. Since the load 89 is transferred from the lifted surface 26 through the clutch mechanism 74 and into the ball screw 56, which without a braking mechanism would tend to cause the ball screw to freely rotate and lower the table, an increased load on the table bearing down on the friction cap increases the amount of friction force between the friction cap 83 and the bottom of the lifted surface. Since the clutch 74 is keyed to the rotating lift member so as to engage the clutch during the lowering motion, the friction cap, which is likewise keyed to the roller clutch, provides the friction interface 85 between the lifting mechanism and the loaded surface. The friction between the friction cap and the lifted surface thereby prevents the ball screw from freely backwinding which maintains the workstation table in the desired orientation.

Since backwinding of the table would cause the ball screw to rotate in the direction which causes the clutch to engage in the lock mode, a friction force is created between the friction cap 83 and the lifted surface 26, which friction force is sufficient to prevent free rotation of the ball screw 56. Moreover, since this friction force is proportional to the load, the amount of friction between the friction cap and the lifted surface is such that a relatively constant torque is required to turn the crank handle 35 to thereby rotate the ball screw to lower the table. Thus, the operator is not aware of the self-braking being provided by the clutch mechanism. Since the thrust bearing 71 and clutch mechanism 74 operate to transmit the load from the lifted surface into the ball screw, the thrust needle bearing provides for ease of rotation of the ball screw with respect to the clutch while lifting, especially with heavy loads.

Therefore, in contrast to prior art height adjustment mechanisms, there is no requirement to adjust the friction force, such as by tightening an adjustment screw, since the friction force is automatically increased with an increase load on the work surface by means of the self-adjusting and self-braking height mechanism of the present invention.

Since the friction force is directly proportional to the load on the table, a relatively lighter weight on the table creates a lesser friction force between the friction cap and the lifted surface such that with relatively light loads on the table there is less friction force to be overcome in rotating the ball screw in the downward direction. This is also an indication of the ease of use to the operator such that the torque required to turn the crank is substantially the same to the user regardless of the direction of motion of the table.

In a most preferred embodiment the friction cap comprises a washer made of a material which has a coefficient of friction between it and the lift surface which in combination with its shape and diameter enables the operation of the device to be as constant as possible to the operator. In order to counter the tendency to backwind the friction cap must be able to impart a torque to the ball screw. This is accomplished by applying a friction force at a distance (moment arm) from the ball screw center line. The friction force is a function of the load being carried through the friction interface and the coefficient of friction between the two surfaces. The average moment arm is determined by the stress distribution of the friction surface. In order to maintain the average moment arm near the outside diameter of the friction cap, it is necessary to raise the surface near the outside diameter. This allows for the material to flex, while the load is carried more at the outside diameter than the inside diameter, thus the average moment arm is near the outside diameter. This ensures that the torque is sufficient to prevent backwinding. Preferably, the friction washer is made of a plastic acetal resin material, such as DELRIN AF sold by DuPont. The selection of this material is preferable because it can withstand the elevated temperatures resulting from continuous frictional sliding and also because the static coefficient of the friction is similar to the dynamic. With other materials, there is a drop in friction as motion begins so there is an unpleasant "breakaway" situation which requires high initial torque, or if this starting torque is kept low, the reduced dynamic friction may be insufficient to prevent backwinding. Moreover, instead of a separate friction cap 83 and outer sleeve 80, the outer sleeve can be sized so as to fit over both the top and sides of the roller clutch 77 and be made of DELRIN AF in order to provide the friction interface.

Figure 5A:
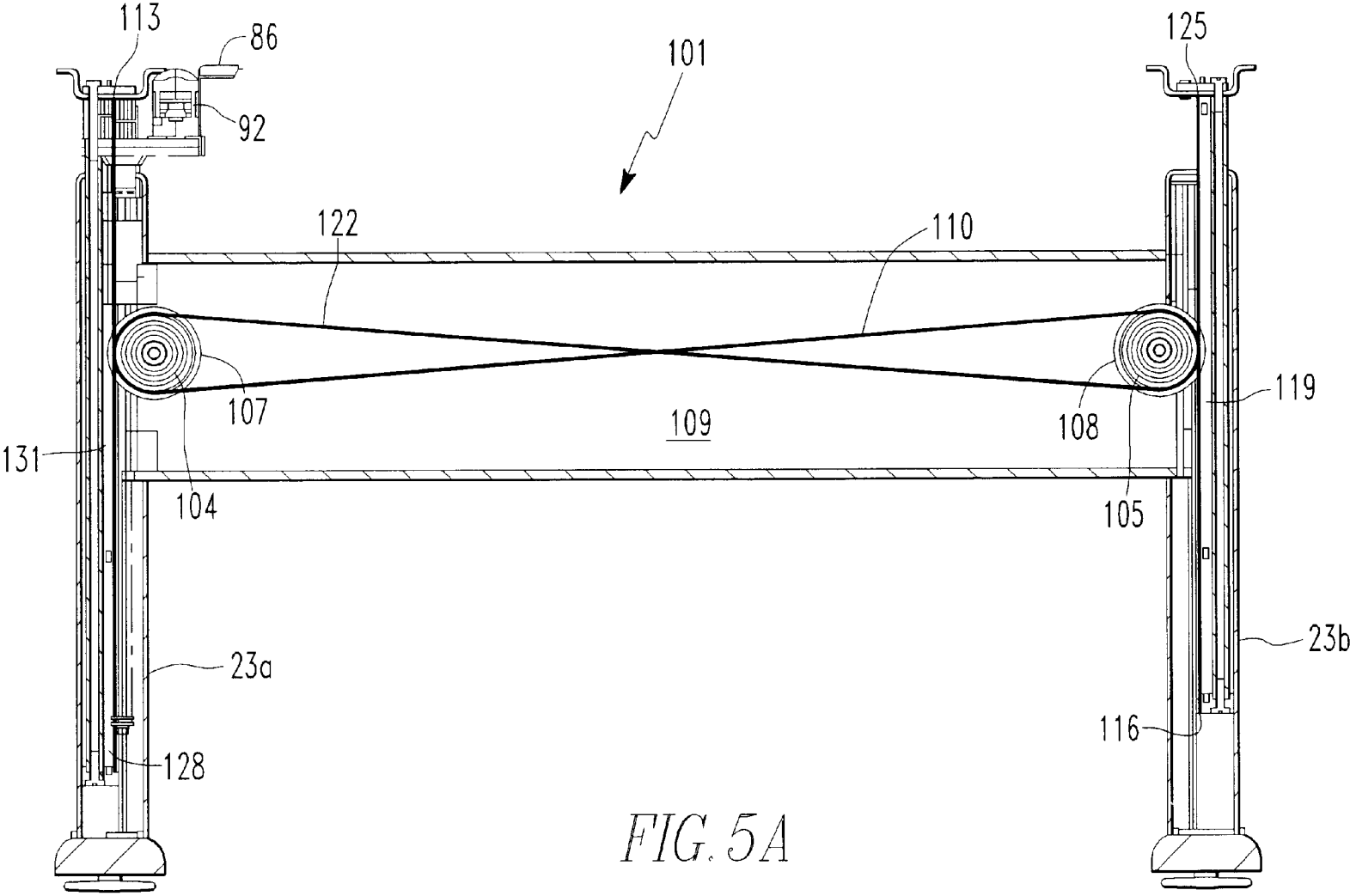
FIG. 5, consisting of FIGS. 5A, 5B and 5C shows a preferred embodiment of the mechanism having a pulley arrangement used to level the adjustable table in the raising or lowering of the work surface.
Figure 5B:
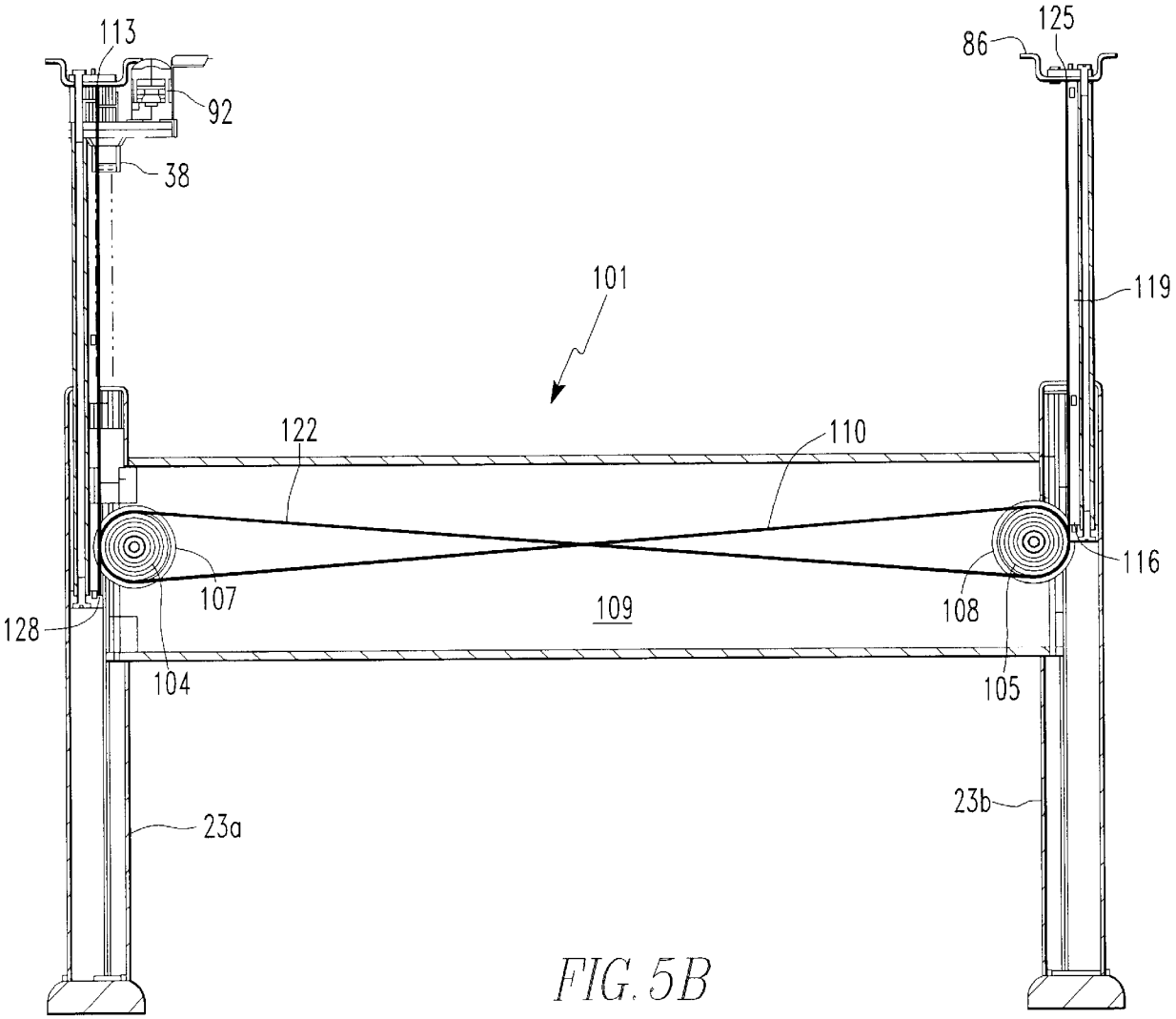
Figure 5C:
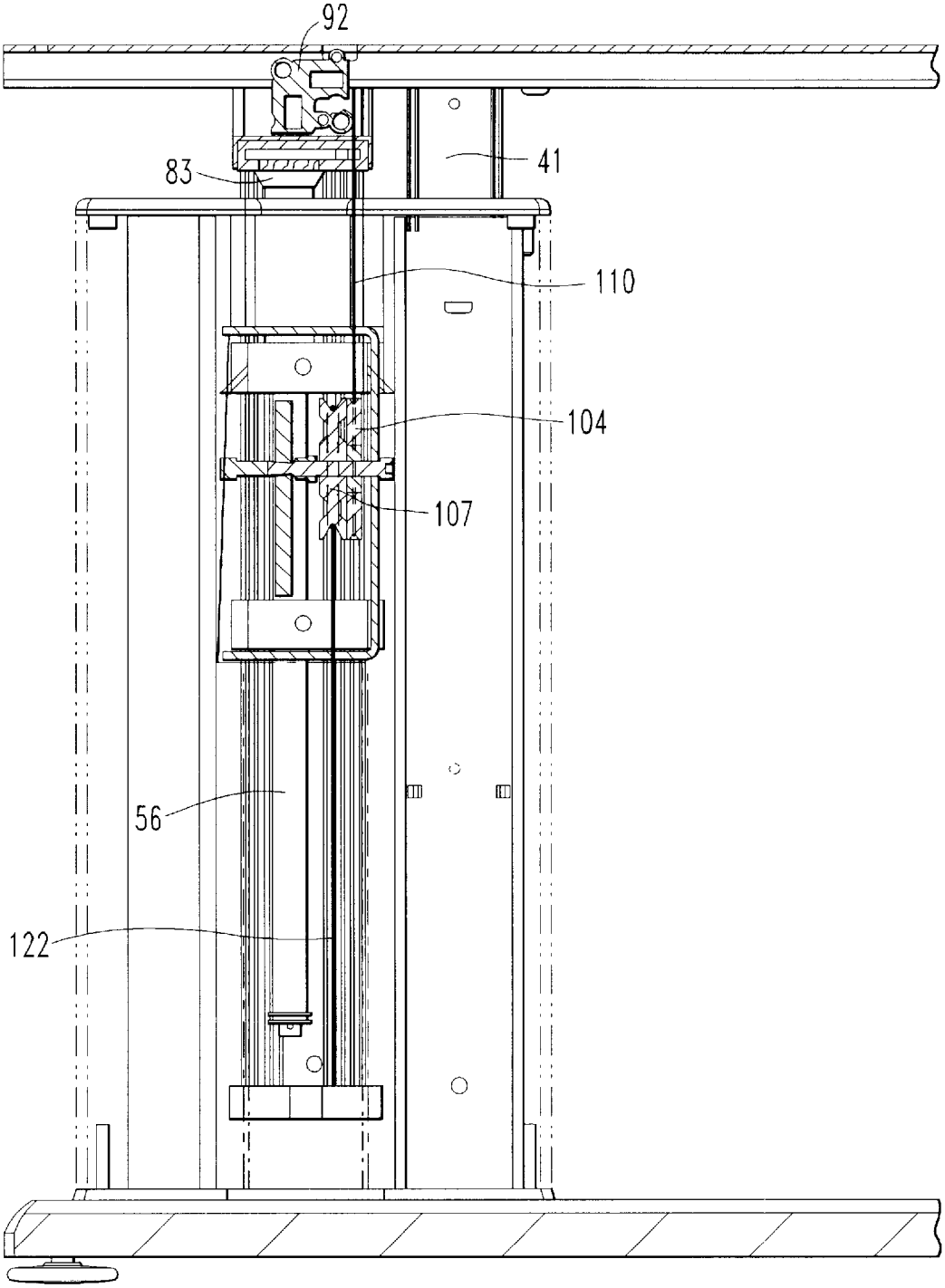

To assist in the raising and lowering of the table and to ensure that it does so in a level manner, the pulley and cable arrangement 101 of FIG. 5 may be provided. FIG. 5 shows the pulley and cable arrangement in a table in the fully lowered position (FIG. 5A), and the fully raised position (FIG. 5B); FIG. 5C is a side view of FIG. 5A. As shown therein, two load pulleys 104, 105 and two guide pulleys 107, 108 are provided within a cross beam 109 that spans the area between the left and right legs 23*a*, 23*b* of the table 20. A first or load cable 110 is attached to the top of the leg which is the same as the leg member which has the self-braking height adjustment mechanism of the present invention. As shown in the Figure, the lift mechanism 38 is associated with the movable portion in the left leg 23*a*. Thus, the load cable 110 is attached securely at one end 113 near the top of the left leg and is routed underneath a load pulley 104 preferably mounted on the left side of the cross beam 109 very close to the left leg, passing therethrough and over the top of the load pulley 105 on the right side of the cross beam 109 and securely attached at its opposite end 116 near the bottom of the right leg 23*b*. This end of the load cable 110 is attached to a compression member 119 which aids in the level raising and lowering of the table 26, as will be described hereinafter. A return or guide cable 122 is similarly attached in a manner opposite to that of the load cable. Thus, the guide cable has one end 125 attached near the top of the right leg 23*b*, passing underneath the guide pulley 108 on the right side of the cross beam attached close to the right leg and progresses through the cross beam 109 over the top of the guide pulley 107 and has its opposite end 128 attached near the bottom of the left leg to a second compression member 131. The arrangement of the guide pulleys and load pulleys are more clearly shown in FIG. 5C.

The compression members operate such that if one end of the table were to be raised or lowered, such as the right side of the table in FIGS. 5A or 5B, the right side pulls by means of the cables 110, 122 on the compression member 131 of the opposite side. In this manner, if enough force is provided to the table, for example to raise it such that the self-adjusting lift mechanism would be operated, the pulley, cables and compression members operate such that both ends of the table are lifted in tandem and generally simultaneously. Thus, this also prevents an uneven raising of the table either when the crank handle is operated or inadvertently such as by someone grabbing on one end of the table, or if one end of the table were to have a relatively heavy load while the other end of the table has very little or none. Thus, an operator has many options both in raising and lowering the table to a desired height as well as in placing objects on the table in any manner. Moreover, only a relatively simple pulley and cable arrangement is necessary, obviating the need for a chain and sprockets.

In the preferred embodiment, in order to convert the horizontal torque from the user to the vertical torque needed to spin the ball screw, a miter gear set is used in the gear box mechanism 82. In a typical application of the preferred embodiment, the shaft carrying the horizontal torque is directed parallel to the leg toward the front edge of the table work surface. In order to accommodate non-rectangular work surfaces, it is desirable to direct the shaft at angles to the leg other than parallel. To accomplish this, the miter gears are captured in a housing which is free to rotate to these other angles. Additionally, this housing can be oriented such that the horizontal shaft is perpendicular to the leg, extending toward the other leg. A second set of miter gears housed in the same or similar housing are connected to the end of the shaft, with a second horizontal shaft directed forward to the user. In this way, the hand crank can be positioned in a variety of locations.

In an alternative arrangement to the pulley and cable assembly described above, the vertically adjustable workstation can be provided with a ball screw and clutch mechanism in each leg to provide a leveling means. In this configuration, both the right and left leg would include a ball screw and clutch mechanism which is operatively connected to the movable portion of the leg. However, in this configuration the second vertical height adjustment mechanism need not be connected to a separate hand crank assembly. By way of example, a single hand crank assembly could be connected to a gear arrangement wherein one shaft is operatively connected to a vertical adjustment mechanism in the left leg, and a second shaft is operatively connected to the second vertical adjustment mechanism in the right leg. In this manner, a single rotation of the hand crank would rotate each shaft which would thereby rotate the ball screws in each leg which would raise or lower the work table accordingly.

In a still further embodiment of the present invention, a workstation could be provided having a single support or leg assembly. In this manner, a stationary pedestal would house the movable vertical height adjustment mechanism having the self-braking feature of the present invention within a channel and provide support for the work surface. As is readily apparent, for desks in which a pedestal comprises the base assembly, no leveling means is necessary.

Figure 6:
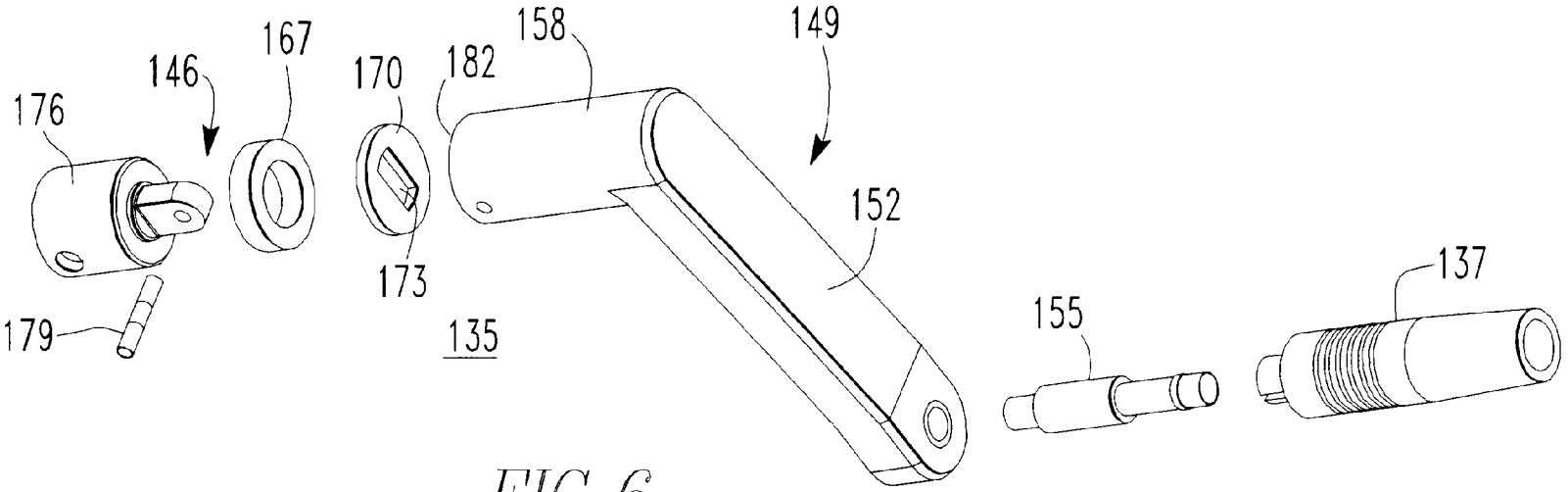
FIG. 6 is an exploded view of a collapsible handle crank mechanism of the present invention; an FIG. 7 is a top view of the handle crank assembly in the collapsed position.
Figure 7:
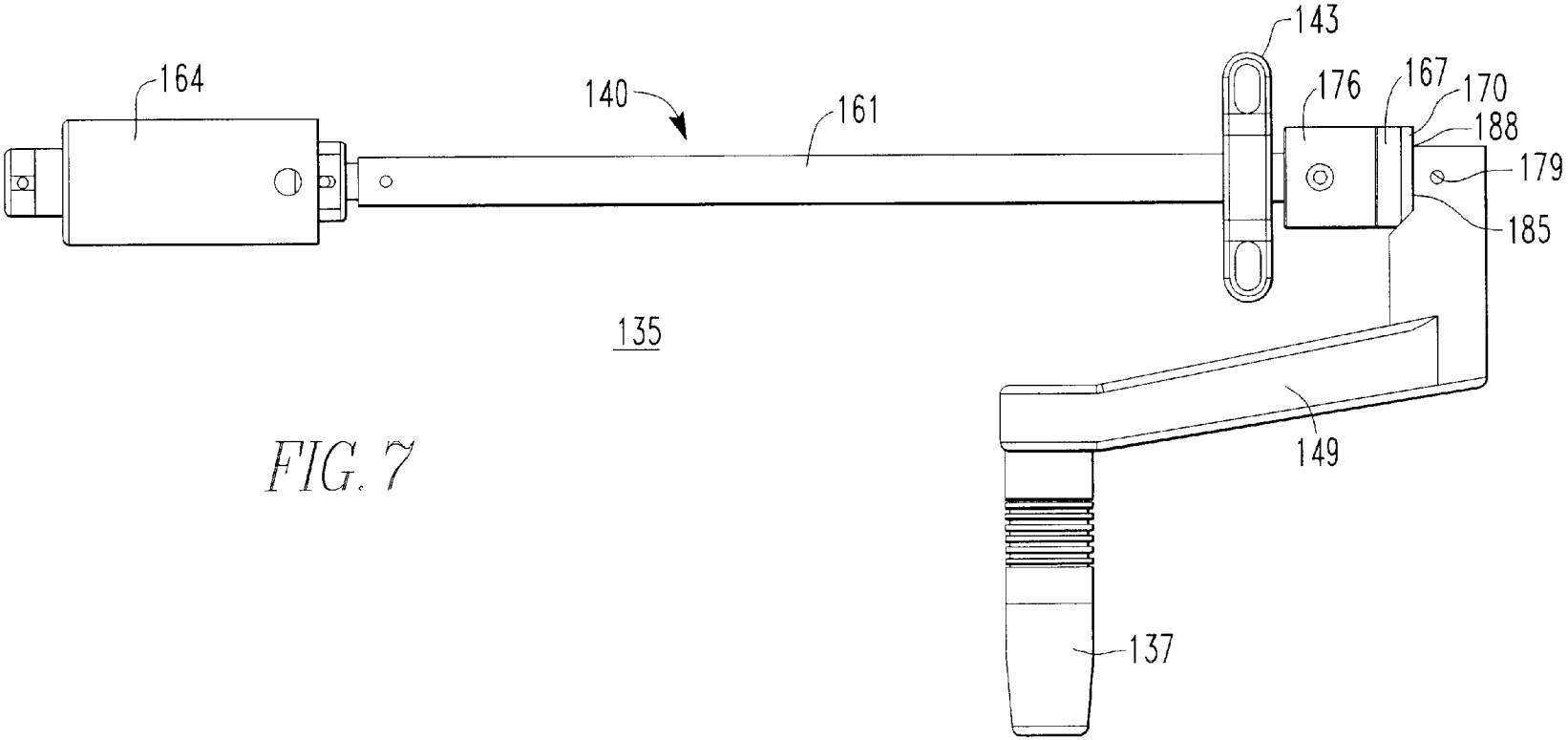

Referring now in detail to FIGS. 6 and 7, the crank handle assembly 135 of the present invention will be described herein. The crank handle 137 which operates the rotating member is attached to a linkage 140 which attaches to the universal joint or gear box 92 which operates the ball screw 56. The gear box 92 has a miter set which transfers the horizontal rotation of the handle 137 by the operator to the vertical rotation and translation of the ball screw 56 for the height adjustment of the work surface 26. The linkage mechanism 140 of the handle crank is secured to the underside of the work surface by bracket 143 and includes a pivoting assembly 146 which allows the crank handle 137 to be folded under the table for the convenience of the operator.

The handle comprises a generally Z-shaped member 149 wherein one leg of the Z is the crank handle 137 which is grippable by the operator and rotates with respect to the upright member 152 by means of the pin 155. The other leg 158 of the Z member is rigidly attached to the upright member 152 and comprises the pivoting assembly 146. On the side of the other leg opposite to the upright member 152 of the Z-shaped member of the handle is attached a shaft 161. The shaft is preferably connected to the end of the gear box 92 by a torque limiter 164. The pivot assembly additionally comprises a spring member 167 and a collar member 170. The collar member is preferably made of a hard material such as steel and has an oblong shaped opening 173 therein. The spring member is preferably made of a stiff, flexible toroidal-shaped material such as polyurethane. The shaft 161 is connected to the other leg of the Z-shaped member by a pivot coupling 176 which is shaped to fit within the oblong opening 173 of the collar, and also passes through the opening of the spring member 167 and is pivotally connected to the shaft by pin 179. In the operating position (FIG. 6), a first surface 182 of the handle abuts against the collar while in the collapsed position (FIG. 7) a second surface 185 of the handle abuts the collar 170. The flexible material of the spring 167 allows the operator to, after the table work surface has been placed in its desired vertical position, fold the handle 137 in a collapsible manner underneath the table (FIG. 7). This is accomplished by means of the operator pushing in on the crank handle 137, so that the handle pivots on pin 179 and the cam portion 188 rotates against the collar 170 which further compresses the spring member 167. With further rotation of the handle, the spring compression is partially relaxed until the second surface 185 abuts against the collar. When the handle has been rotated into the collapsible position, the polyurethane spring pushes outward on the washer 170 which then locks the handle in the collapsed position out of the way of the operator. This is similar to the way the handle is held in the operational position against substantial forces.

Preferably the work surface, comprising a table, is attached to each of the leg members by a bracket. The bracket is secured to the underside of the table such as by screws, and each bracket 86 is secured to a corresponding movable portion 32. In referring to FIG. 2, the leg having the adjustable height mechanism 38 is attached to the bracket 86 through the transfer gear box mechanism 92. The gear box mechanism, which transfers the rotation of the hand crank into the vertical rotation of the ball screw, is securely attached to the bracket and is also securely attached to the ball screw 56. Thus, when the crank handle 137 is rotated, such as to raise the table 26, the rotation is transferred into the vertical rotation of the ball screw 56 which causes the transfer gear box 92 to rise with the ball screw which causes a corresponding raising of the bracket 86 and table 26. Each bracket is also attached to the slide assemblies 41 which are disposed in each leg member 23. Each of the slide assemblies and the vertical height adjustment mechanism are disposed within channels of each of the leg assemblies.

While specific embodiments of the invention have been described in detail, it will be appreciated by those skilled in the art that various modifications and alterations would be developed in light of the overall teachings of the disclosure. Accordingly, the particular arrangements disclosed are meant to be illustrative only and not limiting as to the scope of the invention, which is to be given the full breadth of the appended claims and in any and all equivalents thereof.

I claim:

1. A vertically adjustable workstation comprising:

a work surface;

a base connected to said work surface, said base having a movable portion and a stationary portion, the work surface being connected to the movable portion;

a vertical adjustment mechanism operably associated with the movable portion and having an automatic braking mechanism for locking the work surface in a vertical position; and wherein said base includes a first channel therein and said vertical adjustment mechanism comprises a vertically movable ball screw threadingly engaged with a ball nut rigidly secured within the first channel, the ball screw being operatively connected to said work surface and said automatic braking mechanism and wherein said automatic braking mechanism comprises a clutch assembly disposed around a portion of the ball screw, the clutch assembly allowing for free rotation of the ball screw when the ball screw is rotated in a first direction and engaging the ball screw for rotation therewith when the ball screw is rotated in a second direction.

2. The vertically adjustable workstation of claim 1, wherein rotation of the ball screw in the first direction causes the work surface to be vertically adjusted in an upward direction.

3. The vertically adjustable workstation of claim 1, wherein rotation of the ball screw in the second direction causes the work surface to be vertically adjusted in an downward direction.

4. The vertically adjustable workstation of claim 1, wherein the ball screw includes a shoulder portion thereon and the clutch assembly comprises a roller clutch adjacent the shoulder portion, a thrust bearing disposed between the roller clutch and the shoulder portion, the thrust bearing providing a first rotational interface between the vertical adjustment mechanism and the work surface, and a friction member operatively connected between the roller clutch and the work surface, the friction member providing a second rotational interface between the vertical adjustment mechanism and the work surface.

5. The vertically adjustable workstation of claim 4, wherein the thrust bearing provides the first rotational interface when the ball screw is rotated in the first direction and the friction member provides the second rotational interface when the ball screw is rotated in the second direction.

6. The vertically adjustable workstation of claim 5, wherein rotation of the ball screw in the first direction causes the work surface to be vertically adjusted in an upward direction and the rotation of the ball screw in the second direction causes the work surface to be vertically adjusted in a downward direction.

7. The vertically adjustable workstation of claim 4, wherein the thrust bearing and roller clutch are enclosed within an outer sleeve.

8. The vertically adjustable workstation of claim 4, wherein the friction member comprises a washer made of acetal.

9. The vertically adjustable workstation of claim 1, wherein the movable portion further comprises a slide mechanism.

10. The vertically adjustable workstation of claim 1, wherein the base comprises a pair of legs, each of said legs having a movable portion and a stationary portion, the work surface being connection to each of said movable portions, and one of said movable portions of one of said legs includes the vertical adjustment mechanism.

11. The vertically adjustable workstation of claim 10, further comprising means for vertically moving each of said movable portions generally in tandem such that the work surface is substantially level.

12. A vertically adjustable workstation comprising:

a work surface;

a base connected to said work surface, said base having a movable portion and a stationary portion, the work surface being connected to the movable portion; and a vertical adjustment mechanism operably associated with the movable portion and having an automatic braking mechanism for locking the work surface in a vertical position, wherein said vertical adjustment mechanism comprises a rotating member operatively connected to said work surface and said braking mechanism comprises a clutch assembly operatively connected to said rotating member, wherein the clutch assembly allows for free rotation of the rotating member when rotated in a first direction and engages the rotating member for rotation therewith when the rotating member is rotated in a second direction.

13. The vertically adjustable workstation of claim 12, wherein the rotating member comprises a vertically movable ball screw having a shoulder portion thereon and threadingly engaged with a ball nut rigidly secured within a first channel, and the clutch assembly comprises a roller clutch adjacent the shoulder portion, a thrust bearing disposed between the roller clutch and the shoulder portion, the thrust bearing providing a first rotational interface between the vertical adjustment mechanism and the work surface when the ball screw is rotated so as to adjust the work surface in the first direction, and a friction member operatively connected between the roller clutch and the work surface, the friction member providing a second rotational interface between the vertical adjustment mechanism and the work surface when the ball screw is rotated so as to adjust the work surface in the second direction.

14. A self-braking adjustment mechanism comprising:

a movable portion;

a stationary portion;

a lifting device operatively associated between the movable portion and a load to be lifted, whereby rotation of a rotating member causes the movable portion to be translated with respect to the stationary portion; and a braking means connected to the lifting device such that the rotating member is freely rotated when operated to translate the movable portion in a first direction and said brake means is engaged with the lifting device when the rotating member is operated to translate the movable portion in a second direction.

15. The self-braking adjustment mechanism of claim 10, wherein the rotating member comprises a translating ball screw attached to the movable portion and a ball nut rigidly secured to the stationary portion, the ball screw being threadingly engaged with the ball nut whereby rotation of the ball screw causes the movable portion to be translated with respect to the stationary portion.

16. The self-braking adjustment mechanism of claim 15, wherein said brake means comprises a clutch assembly disposed around a portion of the ball screw, the clutch assembly allowing for free rotation of the ball screw when the ball screw is rotated in the first direction and engaging the ball screw for rotation therewith when the ball screw is rotated in the second direction.

17. The self-braking adjustment mechanism of claim 16, wherein rotation of the ball screw in the first direction causes the movable portion to be translated in an upward vertical direction, and rotation of the ball screw in the second direction causes the movable portion to be translated in a downward vertical direction.

18. The self-braking adjustment mechanism of claim 17, wherein the ball screw includes a shoulder portion thereon and the clutch assembly comprises a roller clutch adjacent the shoulder portion, a thrust bearing disposed between the roller clutch and the shoulder portion, and a friction member operatively connected between the roller clutch and the load, whereby the thrust bearing allows free rotation of the ball screw with respect to the roller clutch when rotated in the first direction and the roller clutch is engaged and rotates with the ball screw when rotated in the second direction.

19. The self-braking adjustment mechanism of claim 18, wherein the friction member is rigidly secured to the roller clutch such that the friction member is frictionally engaged with the load when the ball screw is rotated in the second direction.

20. The self-braking adjustment mechanism of claim 19, wherein the movable portion is adapted to vertically support the load, the first direction is vertically upward and the second direction is vertically downward, such that the movable portion is prevented from freely translating in the downward direction by means of the friction member and the roller clutch.

21. A vertically adjustable desk comprising:

a base assembly comprising a stationary portion having a channel and a movable portion disposed in the channel;

a desk top operatively associated with the movable portion; and a vertical adjustment mechanism attached to the movable portion to move the movable portion with respect to the stationary portion to vertically adjust the desk top, the vertical adjustment mechanism including a vertically movable ball screw attached to the movable portion and threadingly engaged with a ball nut attached to the stationary portion and an automatic braking mechanism for preventing backwinding of the desk top.

22. The vertically adjustable desk of claim 21, wherein said brake mechanism comprises a clutch assembly disposed around a portion of the ball screw, the clutch assembly allowing for free rotation of the ball screw when the ball screw is rotated in a first direction and engaging the ball screw for rotation therewith when the ball screw is rotated in a second direction.

23. The vertically adjustable desk of claim 22, wherein the ball screw includes a shoulder portion thereon and the clutch assembly comprises a roller clutch adjacent the shoulder portion, a thrust bearing disposed between the roller clutch and the shoulder portion, the thrust bearing providing a first rotational interface between the vertical adjustment mechanism and the desk top, and a friction member operatively connected between the roller clutch and the desk top, the friction member providing a second rotational interface between the vertical adjustment mechanism and the desk top.

24. The vertically adjustable desk of claim 23, wherein the movable portion further comprises a slide mechanism.

25. The vertically adjustable desk of claim 21, wherein said vertical adjustment mechanism comprises a rotating member operatively connected to said desk top and said brake mechanism comprises a clutch assembly operatively connected to said rotating member, wherein the clutch assembly allows for free rotation of the rotating member when rotated in a first direction and engages the rotating member for rotation therewith when the rotating member is rotated in a second direction.

26. The vertically adjustable desk of claim 25, wherein the rotating member comprises a vertically movable ball screw having a shoulder portion thereon and threadingly engaged with a ball nut rigidly secured within a first channel, and the clutch assembly comprises a roller clutch adjacent the shoulder portion, a thrust bearing disposed between the roller clutch and the shoulder portion, the thrust bearing providing a first rotational interface between the vertical adjustment mechanism and the desk top when the ball screw is rotated so as to adjust the desk top in the first direction, and a friction member operatively connected between the roller clutch and the desk top, the friction member providing a second rotational interface between the vertical adjustment mechanism and the desk top when the ball screw is rotated so as to adjust the desk top in the second direction.

27. The vertically adjustable desk of claim 21, wherein said base assembly comprises a pair of legs, each of said legs having a movable portion and a stationary portion, wherein one of said legs has associated therewith the vertical adjustment mechanism.

28. The vertically adjustable desk of claim 27, further comprising means for vertically moving each of said movable portions generally in tandem such that the desk top is substantially level.

* * * * *